United States Patent [19]

Largman et al.

[11] Patent Number: 5,057,368

[45] Date of Patent: Oct. 15, 1991

[54] FILAMENTS HAVING TRILOBAL OR QUADRILOBAL CROSS-SECTIONS

[75] Inventors: Theodore Largman, Morristown; Fred J. Gefri, Hacketstown; Frank Mares, Whippany, all of N.J.

[73] Assignee: Allied-Signal, Morris Township, Morris County, N.J.

[21] Appl. No.: 454,209

[22] Filed: Dec. 21, 1989

[51] Int. Cl.[5] ..... D02G 3/00

[52] U.S. Cl. ..... 428/397; 264/177.13; 425/464; 428/401

[58] Field of Search ..... 428/364, 397, 401; 264/177.13, 177.1; 425/464

[56] References Cited

U.S. PATENT DOCUMENTS

| | | | |
|---|---|---|---|
| 3,489,641 | 2/1967 | Harcolinski | 161/177 |
| 3,493,459 | 12/1966 | McIntosh | 161/178 |
| 3,607,611 | 12/1968 | Matsui | 161/173 |
| 3,623,939 | 11/1971 | Ono | 264/177.13 X |
| 3,639,505 | 5/1970 | Hughes | 260/873 |
| 3,640,670 | 2/1972 | Paliyenko | 264/177.13 X |
| 3,738,789 | 6/1973 | Shemdin | 425/464 |
| 3,781,399 | 9/1969 | Kobayashi | 264/171 |
| 3,860,679 | 1/1975 | Shemdin | 264/177.1 X |
| 4,054,709 | 10/1977 | Belitsin et al. | 264/177.13 X |
| 4,118,534 | 5/1977 | Stanley | 428/370 |
| 4,137,394 | 5/1977 | Melhuizen | 528/502 |
| 4,279,053 | 9/1979 | Payne | 15/159 |
| 4,359,557 | 3/1981 | Watkins | 525/437 |
| 4,410,473 | 9/1981 | Iohara | 264/103 |
| 4,410,928 | 5/1981 | Aramaki | 361/400 |
| 4,417,031 | 1/1982 | Aharoni | 525/425 |
| 4,439,487 | 12/1982 | Jennings | 428/397 |
| 4,454,196 | 9/1982 | Iohara | 428/359 |
| 4,457,974 | 7/1980 | Summers | 428/373 |
| 4,559,862 | 4/1982 | Case | 87/1 |
| 4,562,869 | 1/1984 | Blum | 139/413 |
| 4,567,092 | 10/1983 | Catrain | 428/246 |
| 4,587,154 | 7/1985 | Hotchkiss | 428/195 |
| 4,601,925 | 10/1984 | Haz | 428/17 |
| 4,648,830 | 5/1985 | Peterson | 425/464 |
| 4,713,289 | 3/1986 | Shiffler | 428/361 |
| 4,770,938 | 9/1986 | Peterson | 428/398 |
| 4,791,026 | 12/1988 | Yoshimoto et al. | 428/397 |

FOREIGN PATENT DOCUMENTS

| | | | |
|---|---|---|---|
| 280998 | 11/1964 | Australia | 264/177.13 |
| 0198401 | 4/1986 | European Pat. Off. . | |
| 47-21885 | 6/1972 | Japan | 264/177.13 |
| 63-235514 | 9/1988 | Japan | 264/177.13 |
| 63-235515 | 9/1988 | Japan | 264/177.13 |

OTHER PUBLICATIONS

"Fibers from Polymer Blends", D. R. Paul, Polymer Blends, 2 (1978) 167–217.

"Rapid High Temperature Amidation in Presence of Organic Phosphites", S. M. Aharoni, Polymer Bulletin 10 (1983) 210–214.

"II. Man-Made Fibres", J. G. Cook, Handbook of Textile Fibres, (1959) 19–20 and 308.

*Primary Examiner*—Lorraine T. Kendell

*Attorney, Agent, or Firm*—R. C. Stewart, II; G. H. Fuchs; D. L. Webster

[57] ABSTRACT

A trilobal or quadrilobal fiber formed from thermoplastic polymers, said fiber having a cross-section comprised of a central core having three or four T-shaped lobes, the legs of each intersecting at the center of said core such that the angle between the legs of adjacent lobes is from about 80° to about 130°.

16 Claims, 2 Drawing Sheets

FILAMENTS HAVING TRILOBAL OR QUADRILOBAL CROSS-SECTIONS

BACKGROUND OF THE INVENTION

1. Field of the Invention

This invention relates to multilobal fibers having a variety of uses. More particularly, this invention relates to such fibers having at least about three lobes which are useful in such diverse applications as filtering, wicking, insulating and other applications.

2. Prior Art

Nylons such as nylon 6, nylon 66, nylon 4, nylon 610 and nylon 11 are known for use in the manufacture of fibers. Illustrative of these fibers are those described in *J. Gordon Cook, "Handbook of Textile Fibers" 5th Ed. Trowbridge Great Britain* (1984) *pp.* 19–20, 308.

Polyesters are also well known materials for the manufacture of fibers. Illustrative of such fibers are those described in U.S. Pat. Nos. 4,454,196; 4,410,473; and 4,359,557.

Other well known polymeric materials for use in the manufacture of fibers are polyolefins. Illustrative of such fibers are those described in U.S. Pat. Nos. 4,137,391; 4,587,154; 4,567,092; 4,562,869; and 4,559,862.

Fibers containing mixtures of polyolefins and polyesters are known. For example, U.S. Pat. No. 3,639,505 describes fibers and films composed of a polymer alloy comprising an intimate blend of polyolefin, a minor amount of polyethylene terephthalate and 0.2 to 5 parts per hundred parts of polymer of a toluene sulfonamide compound which are described as having improved receptivity to dispersed dyes.

Bicomponent textile filaments of polyester and nylon are known in the art, and are described in U.S. Pat. No. 3,489,641. According to the aforesaid patent, a yarn that crimps but does not split on heating is obtained by using a particular polyester.

It is also known to employ as the polyester component of the bicomponent filament a polyester which is free from antimony. The antimony in the polyester reacts with nylon to form a deposit in the spinnerette which produces a shorter junction line, and thus a weaker junction line. Such products are claimed in U.S. patent application Ser. No. 168,152, filed July 14, 1980.

It is also known to make bicomponent filaments using poly[ethylene terephthalate/5-(sodium sulfo) isophthalate]copolyester as the polyester component. U.S. Pat. No. 4,118,534 teaches such bicomponents.

It is also known to make bicomponent filaments in which one component partially encapsulates the other component. U.S. Pat. No. 3,607,611 teaches such a bicomponent filament.

It is also known to produce bicomponent filaments in which the interfacial junction between the two polymeric components is at least in part jagged. U.S. Pat. No. 3,781,399 teaches such a bicomponent filament. Bicomponent filaments having a cross sectional dumbbell shape are known in the art. U.S. Pat. No. 3,092,892 teaches such bicomponent filaments. Other nylon/polyester bicomponent fibers having a dumbell cross sectional shape having a jagged interfacial surface, the polyester being an antimony-free copolyester having 5-(sodium sulfo) isophthalate units are known. U.S. Pat. No. 4,439,487 teaches such fibers. The surface of such bicomponent filament is at least 75% of one of the polymeric components. Still other nylon/polyester bicomponent sheath/core fibers are described in Japan Patent Nos. 49020424, 48048721, 70036337 and 68022350; and U.S. Pat. Nos. 4,610,925; 4,457,974 and 4,410,928.

Fibers have previously been prepared from blends of polyamides with minor amounts of polyesters such as poly(ethylene terephthalate). Intimate mixing before and during the spinning process has been recognized as necessary to achieve good properties in such blended fibers. It is furthermore known that the fine dispersions in fibers of polymer blends are achieved when both phases have common characteristics such as melt viscosity. See D. R. Paul, "Fibers From Polymer Blends" in *Polymer Blends*, vol. 2, pp. 167–217 at 184 (D. R. Paul & S. Newman, Academic Press 1978).

Graft and block copolymers of nylon 6/nylon 66, nylon 6/poly(thylene terephthalates) and nylon 6/poly(butylene terephthalate) have been formed into grafts which can be spun into fibers. For example, U.S. Pat. No. 4,417,031, and A. Aharoni, Polymer Bulletin, vol. 10, pp. 210–214 (1983) disclose a process for preparing block and/or graft copolymers by forming an intimate mixture of two or more polymers at least one of which includes one or more amino functions, as for example a nylon, and at least one of the remaining polymers includes one or more carboxylic acid functions, as for example a polyester, and a phosphite compound; and thereafter heating the intimate mixture to form the desired block and/or graft copolymers. U.S. Pat. No. 4,417,031 disclose that such copolymers can be spun into fibers.

Multilobal fibers are known. For example, U.S. Pat. Nos. 4,648,830 and 4,770,938 describe hollow trilobal fibers composed of nylons such as nylon 6 and nylon 66. These fibers are disclosed as having improved bulk, soil hiding and resiliency when tuffed into a fiber.

Similarly, U.S. Pat. No. 3,493,450 is directed to trilobal filaments with axial holes in the lobes and the center of the cross-section of the filaments. Such filaments are spun from conventional synthetic polymers such as nylon 6, nylon 66, nylon 4, nylon 610, polyethylene, polypropylene, and polythylene terephthalate U.S. Pat. No. 3,493,459 describes a complex multilobal textile filament having a multitude of holes and lobes and composed of polymers such as nylon 66, nylon 6/bb, nylon 6/610/66, nylon 610, nylon 4, nylon 6, nylon 11, polyethylene terephthalate, polypropylene, and polyethylene. These filaments are disclosed as providing increased cover and exhibiting reduced prismatic luster. European Patent No. 0 189 401 and U.S. Pat. No. 4,713,289 disclose polyester fibers of cruciform cross-section which are disclosed as exhibiting water dispersibility, better uniformity, more opacity, good permeability and an attractive flannel-like hand to the resulting wet-laid fabrics. U.S. Pat. No. 4,279,053 discloses tri or tetra-locular oriented polymeric paint brush bristles which are composed of thermoplastic polymeric materials such as polyamides, polyesters and polyolefins, and which are disclosed as exhibiting excellent uniformity of cross-sectional configuration, amenability to flagging, resistance to curl and overall high performance as a brush bristle.

SUMMARY OF THE INVENTION

The present invention is directed to multilobal fibers having unique properties and to a spinnerette for their manufacture. More particularly, the invention is directed to multilobal fibers formed from thermoplastic polymers, said fiber having a cross-section comprised of a central core having three or four T-shaped lobes projecting therefrom, each of said lobes having a leg and a cap, the leg of each lobe intersecting at the center of said core such that the angle between the legs of adjacent lobes is from about 80° to about 130°, the leg of each of said lobes having an average length, "$W_1$", of from about 4.5 μm to about 890 μm from the center of said central core to said cap and an average width, "$W_t$", of from about 0.5 μm to about 90 μm, the caps of each of said T-shaped lobes having an average length, "$C_1$", of from about 8 μm to about 1600 μm and each of said caps having an average width, "$C_t$", of from about 0.5 μm to about 90 μm, wherein the relative values of $W_1$, $W_t$, $C_1$ and $C_t$ are selected such that:

$$C_1(max)=2W_1-2C_t \text{ and}$$

$$C_1(min)=2W_t.$$

Another aspect of this invention relates to a spinnerette plate for manufacture of the fiber of this invention. The spinnerette comprises at least one nozzle extending therethrough to an orifice, said orifice defined by three or four T-shaped slots each having a leg and a cap, the leg of each of said slots intersecting at the center of said orifice and projecting therefrom, wherein:

the angles between adjacent legs of said slots is from about 80° to about 130°;

the average length of each leg of said T-shaped lobes "$W_1$", is from about 4.5 μm to about 890 μm from the center of said orifice to the cap of the T-shaped slot and the average width of each leg of said T-shaped slot, "$W_t$", is from about 0.5 μm to about 90 μm;

the average length of said caps of said T-shaped lobes, "$C_1$", is from about 4.5 μm to about 1600 μm and the average width of said caps is from about 0.5 μm to about 90 μm;

wherein the relative values of $C_1$, $W_1$, $C_t$ and $W_t$ are selected such that $C_1(max)=2W_1-C_t$ and $C_1(min)=2W_t$.

The fiber of invention exhibits several useful properties. For example, such fibers exhibit high loft and reduced tendency to pack. The fibers are also useful as fluid filter medium and exhibit high efficiency and high capacity for removal of entrained solid particles from fluid streams. The fibers are also useful as liquid absorbents such as towel material, moist cloths as for example wet wipes, oil wipes, medical wipes and hygiene wipes, wound dressings, paint rollers, oil spill absorbents and the like. The fibers also are good insulating materials for use in the fabrication of clothing, sleeping bags and noise absorption panels, and exhibit good liquid wicking properties and can be used for such applications as sportswear, coverstock for incontinence pads and the like.

BRIEF DESCRIPTION OF THE DRAWINGS

The invention will be more fully understood and further advantages will become apparent when reference is made to the following detailed description of the invention and the accompanying drawings in which.

DESCRIPTION OF THE PREFERRED EMBODIMENTS

Figure 1:
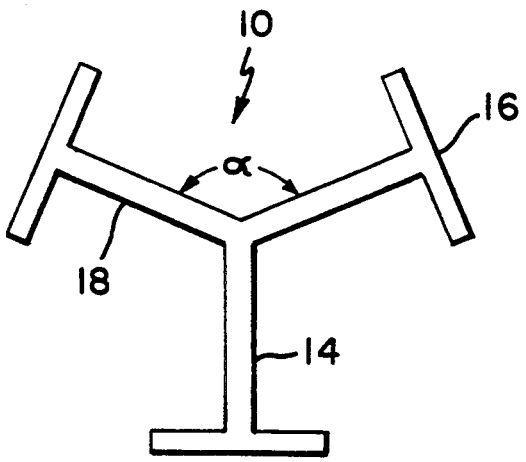
FIG. 1 is a plain view of a trilobal fiber of this invention.
Figure 2:
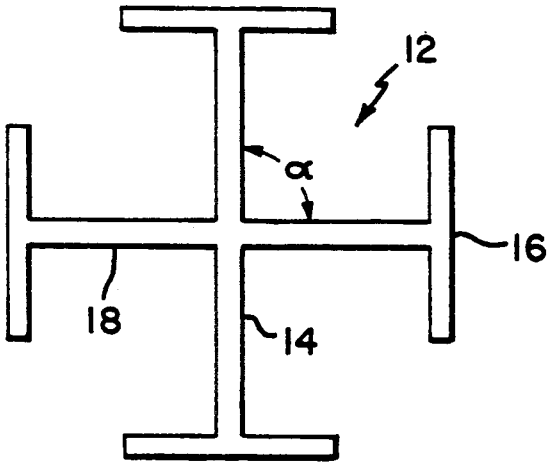
FIG. 2 is a plain view of a quadrilobal fiber of this invention.

The fibers of this invention are trilobal and quadrilobal fibers. The present inventions will be understood by those skilled in the art by reference to the above figures. Referring to FIG. 1 a trilobal fiber of this invention is depicted at 10 having three T-shaped lobes 14 projecting from the central core of fiber 10 and referring to FIG. 2 a quadrilobal fiber of this invention is depicted at 12 having four T-shaped lobes projecting from the core of fiber 12. Each of the T-shaped lobes 14 comprises a cap 16 and a leg 18 and intersects at the core 20 of the fiber. Further description of the fibers of this invention shall be equally applicable to trilobal fiber 10 and quadrilobal fiber 12.

The angle of divergence, α, of leg 18 of one T-shaped lobe 14 from leg 18 of adjacent T-shaped 14 lobe may vary widely and will usually depend on the number of projecting lobes 14. In general, the lobes 14 are divergent from each other by an angle of from about 80° to about 130°. In the preferred embodiments of the invention, where fiber 12 has four projecting T-shaped lobes 14, the angle of divergence of legs 18 is from about 90°±5°, and where the fiber is a trilobal fiber having three projecting T-shaped lobes, the angle of divergence of legs 18 is from about 120°±10°. In the more preferred embodiments of this invention, where the fiber has four projecting T-shaped lobes 14, the angle of avergence of legs 18 of T-shaped lobes 14 is about 90° and where the fiber has three projecting T-shaped lobes 14 the angle of divergence of legs 18 of T-shaped lobes 14 is about 120°.

Each T-shaped lobe 14 comprises a cap 16 and a leg 18. The length and width of the leg 18 of T-shaped lobes may vary widely. In general, the length of each leg 18 is selected such that cap 16 of adjacent T-shaped lobe 14 do not contact to form an enclosed tube like structure. Usually, the length of leg 18 is from about 4.5 to about 890 μm and width of leg 18 is from about 0.5 to about 90 μm. In the preferred embodiments of the invention, the average length of leg 18 is from about 4.5 to about 100 μm and the width of leg 18 is from about 0.5 to about 80 μm, and in the particularly preferred embodiments, the length of leg 18 is from about 4.5 to about 50 μm and the width leg 18 is from about 0.5 to about 60 μm. Amongst the particularly preferred embodiments, most preferred are those embodiments in which the length of leg 18 is from about 4.5 to about 25 μm and the width of leg 18 is from about 0.7 to about 40 μm.

The length of cap 16 can vary from about 4.5 μm to about 1600 μm and the width of cap 16 is from about 0.5 μm to about 90 μm. In the preferred embodiments of the invention, the length of cap 16 is from about 4.5 μm to about 120 μm and the width of cap 16 is from about 0.5 μm to about 80 μm, and in the particularly preferred embodiments of the invention the length of cap 16 is from about 4.5 μm to about 75 μm and the width of cap 16 is from about 0.5 μm to about 60 μm. Amongst these particularly preferred embodiments most preferred are those embodiments in which the length of each cap 16 is from about 4.5 μm to about 50 μm and the width of cap 16 is from about 0.7 μm to about 40 μm.

The length of cap 16 of any fiber will depend on the length and width of leg 18 of T-shaped lobe 14 to which it is attached and to the width of cap 16. For example, in general, the longer leg 18 of T-shaped lobe 14, the longer the permissible length of cap 16. Conversely, the shorter leg 18 of T-shaped lobe 14, the shorter the permissible length of cap 16. The length of leg 18 and cap 16 of adjacent T-shaped lobes 14 are selected such that a T-shaped lobe 14 forms and such that caps 16 of adjacent T-shaped lobes do not intersect. In the preferred embodiments of the invention, the length of cap 16 is governed by the following relationships:

$$C_1(max)=2W_1-2C_l$$

$$C_1(min)=2W_l.$$

where $C_l$ (max) is the maximum permissible cap length and $C_l$ (min) is the minimum permissible cap length.

In certain applications, such as filtering extrained solids from fluid streams and liquid wicking and imbibition the "modification ratio" of the fiber can affect its effectiveness. As used herein, the "modification ratio" is the ratio of the average distance from the top of T-shaped lobes 14 of the fiber to the longitudinal center of axis of the fiber to the average distance from the base of T-shaped lobes 14 of the fiber to the longitudinal center of axis of the fiber. In general, the greater the modification ratio of the fiber, the greater the effectiveness of the fiber as a filtering element or in wicking applications; and conversely, the less its effectiveness as a filtering element or is wicking applications. In the preferred embodiments of the invention, the modification ratio of the fiber is at least about 1.0, and in the particularly preferred embodiments of the invention is from about 2 to about 7. Amongst these preferred embodiments, most preferred are those these preferred embodiments, most preferred are those embodiments in which the modification ratio of the fiber is from about 2.2 to about 5.

Any polymer that can be spun into a fiber can be used in the process of this invention. Illustrative of polymers which may be utilized in the process of this invention are synthetic linear polycarbonamides characterized by the presence of recurring carbonamide groups as an integral part of the polymer chain which are separated from one another by at least two carbon atoms. Polyamides of this type include polymers, generally known in the art as nylons, obtained from diamines and dibasic acids having the recurring unit represented by the general formula:

$$-NHCORCONHR^1-$$

in which R is an alkylene group is at least two carbon atoms, preferably from about 2 to about 10 or arylene preferable substituted or unsubstituted phenylene; and $R^1$ is selected from R and phenyl groups. Also included are copolyamides and terpolyamides obtained by known methods, as for example, by condensation of hexamethylene diamine and a mixture of dibasic acids consistin9 of terephthalic acids and derivatives thereof, as for example, lactams.

Polyamides of the above description are well known in the art and include, for example, the copolyamide of 30% hexamethylene diammonium isophthalate and 70% hexamethylene diammonium adipate, the copolyamide of up to 30% bis-(P-amidocyclohexyl)methylene, and terephthalic acid and caprolactan, poly(hexamethyleneadipamide) (nylon 66), poly(4-aminobutyric acid) (nylon 4), poly(7-aminoheptanoic acid) (nylon 7), poly(8-aminooctanoic acid) (nylon 8), poly(6-aminohexanoic acid) (nylon 6), poly(hexamethylene sebacamide) (nylon 6,10), poly(hapta-methylene pimelamide) (nylon 7,7), poly(octamethylene suberamide) (nylon 8,8), poly(hexamethylene sebacamide) (nylon 6,10), poly(nonamethylene azelamide) (nylon 9,9), poly(decamethylene azelamide) (nylon 10,9), poly(decamethylene sebacamide (nylon 10,10). poly[-bis(4-amino-cyclohexyl)methane-1,10-decanedicarboxamide][(Oiana) (trans)], poly(m-xylene adipamide), poly(p-xylene sebacamide), poly(2,2,2-trimethylhexamethylene pimelamide), poly(piperazine sebacamide), poly(meta-phenylene isophthalamide) (Nomex), poly(p-phenylene terephthalamide) (Kevlar), poly(11-aminoundecanoic acid) (nylon 11) poly(12-aminododecanoic acid) (nylon 12), polyhexamethylene isophthalamide, polyhexamethylene terephthalamide, poly(9-aminononanoic acid) (nylon 9) polycaproamide, or combinations thereof. The polyamide for use in the most preferred embodiments of this invention is polycaprolactam which is commercially available from Allied Corporation under the tradename Capron® Nylon.

Other polymers which may be employed in the process of this invention are linear polyesters. The type of polyester is not critical and the particular polyester chosen for use in any particular situation will depend essentially on the physical properties and features, i.e., tensile strength, modulus and the like, desired in the final fiber. Thus a multiplicity of linear thermoplastic polyesters having wide variations in physical properties are suitable for use in the process of this invention. The particular polyester chosen for use can be a homopolyester or a co-polyester, or mixtures thereof as desired. Polyesters are normally prepared by the condensation of an organic dicarboxylic acid and an organic diol, and, therefore, illustrative examples of useful polyesters will be described hereinbelow in terms of these diol and dicarboxylic acid precursors.

Polyesters which are suitable for use in this invention are those which are derived from the condensation of aromatic and cycloaliphatic dicarboxylic acids and may be cycloaliphatic, aliphatic or aromatic polyesters.

Exemplary of useful cycloaliphatic, aliphatic and aromatic polyesters which can be utilized in the practice of their invention are poly(ethylene terephthalate), poly(cyclohexylenedimethylene, terephthalate, poly(-lactide), poly(ethylene azelate), poly(butylene terephthalate, poly[ethylene(2,7-naphthalate)], poly(-glycolic acid), poly(ethylene succinate), poly(ethylene adipate), poly(ethylene sebacate), poly(ethylene sebacate), poly(decamethylene adipate), poly(decamethylene sebacate), poly(α,α-dimethylpropiolactone), poly(-para-hydroxybenzoate) (akono), poy(ethyene oxybenzoate) (A-tell), poly(ethylene isophthalate), poly(tetramethylene terephthalate, poly(hexamethylene terephthalate), poly(decamethylene terephthalate), poly(1,4-cyclohexane dimethylene terephthalate) (trans), poly(ethylene 1,5-naphthalate), poly(ethylene 2,6-naphthalate), poly(1,4-cyclohexylidene dimethylene terephthalate) (Kodel) (cis), and poly(1,4-cyclohexylidene dimethylene terephthalate (Kodel) (trans).

Polyester compounds prepared from the condensation of a diol and an aromatic dicarboxylic acid are preferred for use in this invention. Illustrative of such useful aromatic carboxylic acids are terephthalic acid, isophthalic acid and an o-phthalic acid, 1,3-, 1,4-, 2,6-or 2,7-napthalenedicarboxylic acid, 4,4'-diphenyl-dicarboxylic acid, 4,4'-diphenysulphone-dicarboxylic acid, 1,1,3-trimethyl-5-carboxy-(p-carboxyphenyl)-indane, diphenyl ether 4,4'-dicarboxylic acid, bis-p(carboxyphenyl)methane and the like. Of the afore-mentioned aromatic dicarboxylic acids based on a bezene ring such as terephthalic acid, isophthalic acid, orthophthalic acid are preferred for use and amongst these preferred acid precursors, terephthalic acid is particularly preferred.

In the most preferred embodiments of this invention, poly(ethylene terephthalate), poly(butylene terephthalate), and poly(1,4-cyclohexane dimethylene terephthalate), are the polyesters of choice. Among these polyesters of choice, poly(ethylene terephthalate) is most preferred.

Still other polymers which may be used in the practice of this invention are polymers derived from unsaturated monomers of the formula:

$$R_1R_2C{=}CH_2$$

wherein $R^1$ and $R_2$ are the same or different and are hydrogen, alkyl, phenyl, alkoxyphenyl, halophenyl, alkylphenyl, haloalkyl, naphthyl, cyano, phenoxy, hydroxy, carboxy, alkanoyl, amino, halogen, amide, nitride, alkoxycarbonyl, phenol, alkylamino, alkoxy, alkoxyalkyl, dialkylamino, carbazole, phenylcarbonyl, phenoxycarbonyl and pyrrolidino.

Illustrative of such polymers are polyvinyl chloride, polyvinylene fluoride, polyacrylamide, polyacrylonitrile, polyvinyl pyridine, polyvinyl acetate, polyacrylic acid, polyvinyl pyrrolidine, polyvinyl methyl ether, polyvinyl formal, poly (P-vinyl phenol), polystyrene, polyethylene, polypropylene, polyl(1-octadecene), polyisobutylene, poly(10pentene), poly(2-methylstyrene), polY(4-methylstyrene), poly(1-hexene), poly(5-methyl-1-hexene), poly(4-methylpentene), poly(1-butene), poly(3-methyl-1-butene), poly(3-phenyl-1-propene), polybutylene, poly(methyl pentene-1), poly(1-hexene), poly(5-methyl-1-hexene), poly(1-octadecene), poly(vinyl cyclopentane), poly(vinylcyclohexane), poly(α-vinylnaphthalene), and the like.

Preferred for use in the practice of this invention are polyolefins of the above referenced formula in which R is hydrogen or alkyl having from 1 to about 12 carbon atoms such as polyethylene, polypropylene, poly-isobutylene, poly(4-methyl-1-pentene), poly(1-butene), poly(1-pentene), poly(3-methyl-1-butene), poly(1-hexene), poly(5-methyl-1-hexene), poly(1-octene), and the like.

In the particularly preferred embodiments of this invention, the polyolefins of choice are those in which $R_1$ is hydrogen and $R_2$ is hydrogen or alkyl having from 1 to about 8 carbon atoms such as polyethylene, polypropylene, poly(isobutylene), poly(1-pentene), poly(3-methyl-1-butene), poly(1-hexene), poly(4-methyl-1-pentene), and poly(1-octene). Amongst these particularly preferred embodiment, most preferred are those embodiments in which $R_1$ is hydrogen and $R_2$ is hydrogen or alkyl having from 1 to about 6 carbon atoms such as polyethylene, polypropylene, poly(4-methyl-1-pentene), and polyisobutylene, with polypropylene being the polyolefin of choice.

In the most preferred embodiments of the invention, the polymer used is a blend of one or more polyesters preferably poly(ethylene terephthalate), poly(butylene terephthalate), or poly(1,4-cyclohexane dimethylene terephthalate) and one or more polyolefins preferably polyethylene, polypropylene, poly(4-methyl-1-pentene) or polyisobutylene. The relative amounts of polyolefins and polyesters in the blend may vary widely. Usually the amount of polyolefin in the blend is from about 0.5 to about 25 percent by weight and the amount of polyester is from about 75 to about 95.5 percent by weight, based on the total weight of the fiber. In the preferred embodiments of this invention, the amount of melt spinnable polyolefins is from about 1 to about 15 weight percent, and the amount of polyester is from about 98 to about 85 weight percent based on the total weight of the fiber. In the particularly preferred embodiments of the invention the amount of melt spinnable polyolefins in the fiber is from about 2 to about 10 weight percent and the amount of polyester is from about 98 to about 90 weight percent based on the total weight of the fiber. Amongst the particularly preferred embodiments, most preferred are those embodiments in which the amount of melt spinnable polyolefins is from about 3 to about 8.5 percent by weight and the amount of polyester is from about 97 to about 91.5 weight percent based on the total weight of the fiber.

Various other optional ingredients, which are normally included in fibers formed from thermoplastic polymers may be added to the mixture at an appropriate time during the conduct of the process. Such optional components include fillers, plasticizers, colorants, mold release agents, antioxidants, ultra violet light stabilizers, lubricants, anti-static agents, fire retardants, and the like. These optional components are well known to those of skill in the art, accordingly, will not be described herein in detail.

The polymers used in the practice of this invention are of "fiber forming molecular" weight. As used herein a "fiber forming Molecular weight" in a molecular weight sufficiently hight to allow spinning of the polymer into fiber. In general, the number average molecular weight (M) of the polymer is at least about 1000. In the preferred embodiments of the invention, the number average molecular weight of the polymer is from about 1000 to about 1,000,000 and in the particularly preferred embodiments is from about 10,000 to about 200,000. In the most preferred embodiments of the invention, the number average molecular weight of the polymer is from about 20,000 to about 100,000.

The term number average molecular weight M is used herein is defined as follows:

$$\overline{Mn} = \frac{\sum_{i=1}^{\infty} M_i N_i}{\sum_{i=1}^{\infty} N_i}$$

wherein the summation:

$$\sum_{i=1}^{\infty} N_i$$

represents the total number of molecules is a sample, $N_i$ represents the number of molecules of molecular weight $M_i$ and the summation:

$$\sum_{i=1}^{\infty} M_i N_i$$

represents the total weight of the sample.

The fiber of this invention can be manufactured using conventional fiber forming techniques. For example, the fiber can be formed by spinning a "fiber spinning composition" through a spinnerate having a configuration sufficient to provide a fiber having the cross-section. As used herein, a "fiber spinning composition" is a melt or solution of a polymer of fiber forming molecular weight. The nature of the spinning composition may vary widely. For example, the spinning composition may be a melt of a polymer or other material used in the formation of the fiber, and may be spun using conventional techniques as for example those melt spinning techniques described in "Man Made Fibers Science and Technology" Vol. 1-3, H. F. Mark et al., Interscience New York, 1968 and "Encyclopedia of Polymer Science and Technology," Vol. 8. Similarly, the fiber spinning composition may be a solution of the polymer and other material used in the formation of the fiber which may be spun by using conventional solution spinning techniques, as for example those described in U.S. Pat. Nos. 2,967,085; 4,413,110; 3,048,465; 4,551,299 and 4,599,267; British Patent Nos. 985,729 and 1,100,497; and in the article by M. E. Epstein and A. J. Rosenthal, Textile res. J. 36,813 (1966).

Spinning apparatus used in the practice of this invention may vary widely and the extrusion step of our process may be conventional extrusion apparatus for spinning ordinary fibers of the same polymer. Thus, for example, in the melt spinning of nylon 6 and polyethylene terephthalate fibers, ordinary powder or pellet feed systems, extruders and spinneretes may be used as described in "Encyclopedia of Polymer Science and Technology", Vol. 8, pps. 326-381. Similarly, in the solution spinning of polyethylene, polyacrylonitrile and polyvinyl alcohol conventional solution spinning systems as described in British Patent 1,100,497; and U.S. Pat. Nos. 3,536,219; 3,048,465; and 4,421,708.

Figure 3:
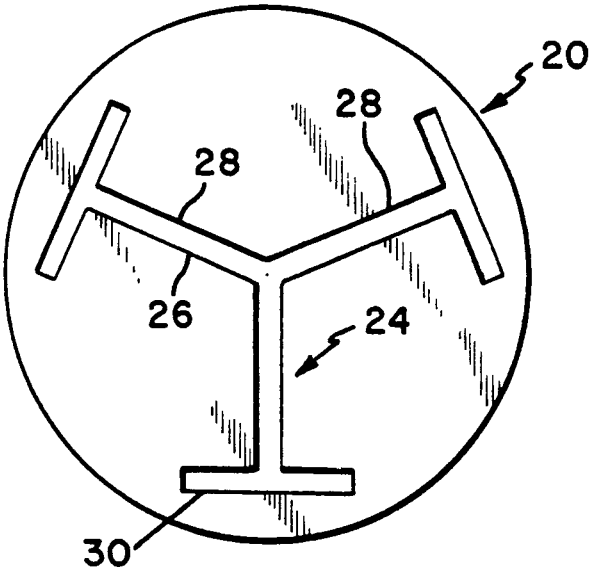
FIG. 3 is a plain view of one filament forming bore of the spinnerette of this invention for forming the trilobal fiber of FIG. 1.
Figure 4:
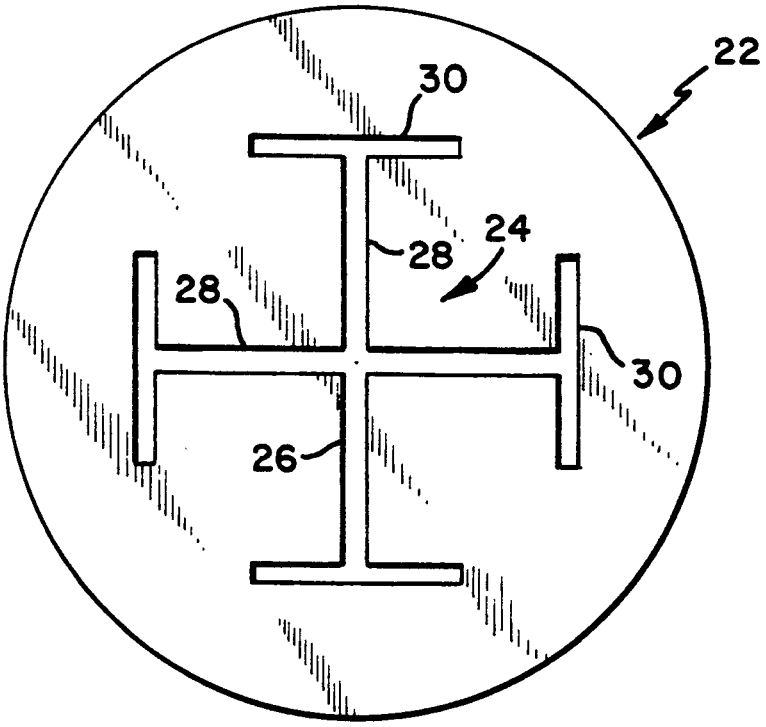
FIG. 4 is a plain view of one filament forming base of the spinnerette of this invention for forming the quadrilobal fiber of FIG. 2.

The fibers of this invention are preferably formed using the spinnerette of this invention. The spinnerette of this invention comprises one or more filament forming bores is depicted in FIGS. 3 and 4 as 20 and 22. The dimensions of each bore 24 is such that the fiber of this invention is formed. As shown in FIGS. 3 and 4, each bore 24 consists of three or four T-shaped slots 26, each slot having a leg 28 and a cap 30. In general, the length of leg 28 is from about 4.5 μm to about 890 μm, and is preferably from about 4.5 μm to about 100 μm, more preferably from about 4.5 μm to about 50 μm and most preferably from about 4.5 μm to about 25 μm. The length of cap 30 is generally from about 4.5 μm to about 1600 μm, preferably from about 4.5 μm to about 120 μm, more preferably from about 4.5 μm to about 75 μm and most preferably from about 4.5 μm to about 50 μm. The width of each cap 30 is generally from about 0.5 μm to about 90 μm, preferably from about 0.5 μm to about 80 μm, more preferably from about 0.5 μm to about 60 μm, and most preferably from about 0.7 μm to about 40 μm, and the width of leg 28 is generally from about 0.5 μm to about 90 μm, preferably from about 0.5 μm to about 80 μm, more preferably from about 0.5 μm to about 60 μm and most preferably from about 0.7 μm to about 40 μm. In one preferred embodiment of the invention depicted in FIG. 3 the length of leg 28 is about 0.0889 cm, the length of cap 30 is about 0.1019 cm, the width of cap 30 is about 0.01016 cm and the width of leg 28 is about 0.01016 cm. In another preferred embodiment of the invention depicted in FIG. 4, the length of leg 28 is about 0.1016 cm, the length of cap 30 is about 0.0762 cm, the width of cap 30 is about 0.01016 cm and the width of leg 28 is about 0.01016 cm. A spinnerelle can be drilled with a plurality of bore holes 24 using any of the well known methods of drilling and punching. The spinnerette can be assembled with other conventional parts such as a spinning pack and molten fiber forming polymer such as nylon 6, nylon 66 and poly(ethylene terephthalate) extruded into a quench, stretched and drawn and taken up onto the package. The yarn may be subjected to further processing such as dyeing, crimping and the like.

In the preferred embodiments of this invention, the fiber is foamed. Such foamed fibers can be prepared by using conventional foaming techniques, as for example U.S. Pat. Nos. 4,562,022; 4,544,594; 4,380,594 and 4,164,603.

The fibers produced form the composition of this invention can be employed in the many applications in which synthetic fibers are used, and are particularly suited for use in the fabrication of filter elements of various types of air and liquid filters, such as air and liquid filters for industrial applications as for example filters for internal combustion engines, clarification filters for water and other liquids, compressed air filters, industrial air filters and the like employing conventional techniques. Fibers of this invention exhibit enhanced capacity and efficiency when are used as filter elements, as compared to polyesters which do not include minor amounts of the polyolefin.

The fibers of this invention are also useful in the fabrication of coverstock for absorbent materials in the manufacture of diapers, incontinence pads, towel materials, moist cloths, such as wet wipes, oil wipes, medical wipes and hygiene wipes, wound pads and dressings, oil spill absorbents and the like.

The fibers of this invention may also be used as seed bed and land scoping fibers because of water imbibition characteristics, and can be used as heat and noise insulating materials for such applications as sportswear, sleeping bags and noise absorption panels.

The following examples are presented to more particularly illustrate the invention and are not to be construed as limitations thereon.

EXAMPLE I

A 3 denier trilobal fiber of this invention composed of from 97% by wt of polyethylene terephthalate and 3% wt of polypropylene was made. Resin pellets were feed to a one inch (2.54 cm) diameter by 30 inch (76.2 cm) extruder, consisting of an electircally heated barrel, electrically heated block and metering gear pump assembly and an electrically heated die assembly. The die or spinnerette contained 20 openings each consisting of 3 adjoining T-shaped openings aligned at 120° to each other with dimensions of 0.004 in (0.01016 cm) web width of 0.035 in (0.0889 cm) long with 0.040 in (0.101 cm) caps. A multilayer screen pack is placed before the die. Temperature were set from 282° C. in 298° C. on the barrel, and the pump block and die were set at 315° C. Through put was at 1 lbs/75 min (0.446 kg/75 min). A spin finish was applied before the take-up godet. Godet speeds and temperatures were set at:

#1-1000 rpm (3216 ft/min) (980 m/min) and 110° C.
#2-4320 rpm (6948 ft/min) (2117 m/min) and 180° C.

EXAMPLE II

Using the equipment and procedure of Example I, a 3 denier quadrilobal fiber of this invention composed of 95% by weight of polyethylene terephthalate and 5% polypropylene was made.

A 3 denier quadrilobal fiber of this invention composed of from 95% by wt of polyethylene terephthalate and 5% by wt. of polypropylene was made. Resin pellets were fed to a one inch (2.59 cm) diameter by 30 inch (76.2 cm) long extruder consisting of an electrically heated barrel, electrically heated block and metering pump assembly. The die or spinnerette contained 20 openings each consisting of 4 adjoining T-shaped openings aligned at 90° C. to each other with dimensions of 0.004 web width by 0.035" long with 0.040" (0.01018 cm) caps. A multilayer screen pack is placed before the die. Temperatures were set from 282° C. to 290° C. on the barrel, and the pump block and die were set at 287° C. Thruput was at 1 lb/75 min (0.35 Kg/hr). A spin finish was applied before the take-up godet.

Godet speed and temperatures were set at:

#1-1400 RPM (2250) ft/min)(685 m/min) @55° C.
#2-3000 RPM (4825 ft/min)(1470 m/min) @180° C.
#3-3000 RPM (4825 ft/min)(1470 m/min) @180° C.

COMPARISON EXAMPLE II

Using the equipment of Example I, a hexalobal 3 denier fiber was made which was composed of 95% by weight of polyethylene terephthalate (0.95 IV) and 5% by weight polypropylene. The die or spinnerette had 48 openings which were hexalobal in shape with over all dimension of 0.00 4 in (0.010 cm)×0.035 in (0.089 cm) per leg. The temperature on the barrel were 282° C. and the temperature on the block and die assembly were at 323° C. Through put was at 3 lbs/hours (1.34 kg/hr). The same spin finish was used as in Examples I and II, and godets were set at:

#1-1760 rpm (2830 ft/min) (862 m/min) and 100° C.
#2-3360 rpm (5404 ft/min) (1647 m/min) and 185° C.
#3-3300 rpm (5307 ft/min) (1617 m/min) and 185° C.

COMPARISON EXAMPLE II

Two tests were carried out on the fibers of Examples I and II, and the fiber of Comparison Example I to evaluate their capacity for water imbibition. In one test, the dry fibers were weighed. The fibers were then soaked in water, and passed through a hand wringer. The wrung fibers were then weighed. In the second test, the soaked fibers were placed on a 10 inch (25.4 cm) screen and excess water was allowed to drip from the fiber by gravity. The results of the tests are set forth in the following Table I.

TABLE I

| Exp No | Fiber | % Water Imbibition (Q)[a] Wringer | Gravity |
|---|---|---|---|
| 1 | Ex I | 284 | 1380 |
| 2 | Comp Ex I | 212 | 1280 |

[a]$Q = \frac{(\text{weight of wet fibers} - \text{weight of dry fibers})}{\text{weight of dry fibers}} \times 100)$

What is claimed is:

1. Multilobal fibers composed of a thermoplastic polymer, said fiber having a cross-section comprised of a central core having three or four T-shaped lobes projecting therefrom, each of said T-shaped lobes having a leg and a cap, the legs of each of said lobes intersecting at the center of said core such that the angle between the legs of adjacent T-shaped lobes is in the range of from about 80° to about 130°, the legs of each of said T-shaped lobes having an average length, "$W_1$", of from about 4.5 to about 25 μm. from the center of said central core, and an average width, "$W_t$", of from about 0.5 to about 20 μm, the caps of each of said T-shaped lobes having an average length, "$C_l$", of from about 4.5 to about 50 μm and each of the caps having an average width, $C_t$", of from about 0.5 to about 20 μm, wherein the relative values of $W_1$, $W_t$, $C_1$and $C_t$ are selected such that:

$$C_1(max) = 2W_1 - 2C_t \text{ and}$$

$$C_1(min) = 2W_t.$$

2. A fiber according to claim 1 wherein the length of said legs is from about 4.5 to about 890 μm.

3. A fiber according to claim 2 wherein the length of said legs is from about 4.5 to about 100 μm.

4. A fiber according to claim 1 wherein the width of said legs is from about 0.5 to about 90 μm.

5. A fiber according to claim 4 wherein the width of said legs is from about 0.5 to about 80 μm.

6. A fiber according to claim 1 wherein the length of said caps is from about 4.5 to about 1600 μm.

7. A fiber according to claim 6 wherein the length of said caps is from about 4.5 to about 120 μm.

8. A fiber according to claim 1 wherein the width of said caps is from about 0.5 to about 90 μm.

9. A fiber according to claim 8 wherein the width of said caps is from about 0.5 to about 80 μm.

10. A fiber according to claim 1 wherein said thermoplastic polymer is a nylon, a polyester, a polyolefin or a combination thereof.

11. A fiber according to claim 1 having a modification ratio of from about 1.5 to about 10.

12. A fiber according to claim 10 wherein said polymer is a nylon selected from the group consisting of nylon 6 and nylon 66.

13. A fiber according to claim 10 wherein said fiber comprises a mixture of a polyester and a polyolefin.

14. A fiber according to claim 13 wherein said polyester is poly(ethylene terephthalate) and said polyolefin is polypropylene.

15. A fiber according to claim 1 wherein said fiber is a trilobal fiber in which the angle between adjacent lobes is about 120° and wherein the lengths of the legs of the lobes are equal or substantially equal.

16. A fiber according to claim 1 wherein said fiber is a quadrilobal fiber in which the angle between the legs of adjacent lobes is about 90°, and wherein the lengths of the legs of said lobes are equal or substantially equal.

* * * * *